US005443776A

United States Patent [19]

Bartholomew et al.

[11] Patent Number: 5,443,776

[45] Date of Patent: Aug. 22, 1995

[54] PROCESS OF IMPROVING AT LEAST ONE PROPERTY OF VISCOSE FILAMENTS

[75] Inventors: Alan J. Bartholomew, Coventry; Paul L. Probert, Rugby; Michael Richardson, Derby; Andrew G. Wilkes, Coventry, all of United Kingdom

[73] Assignee: Courtaulds plc, London, United Kingdom

[21] Appl. No.: 212,154

[22] Filed: Mar. 14, 1994

[30] Foreign Application Priority Data

Mar. 24, 1993 [GB] United Kingdom ..... 9306074

[51] Int. Cl.[6] ..... D01F 2/06; D02G 1/00

[52] U.S. Cl. ..... 264/168; 264/196; 264/197; 264/211.15

[58] Field of Search ..... 264/168, 196, 197, 211.14, 264/211.15

[56] References Cited

U.S. PATENT DOCUMENTS 2,368,637 2/1945 Bruenner et al. ..... 28/262
3,720,743 3/1973 Stevens et al. ..... 264/168
3,793,136 2/1974 Daul et al. ..... 264/196 X
5,042,111 8/1991 Iyer et al. ..... 19/65 T
5,042,122 8/1991 Iyer et al. ..... 28/283

FOREIGN PATENT DOCUMENTS 879353 3/1960 United Kingdom .
1312455 8/1969 United Kingdom .
1226722 3/1971 United Kingdom .
1387566 3/1975 United Kingdom .

OTHER PUBLICATIONS

European Search Report for Application No. 94 30 2003 (completed Jul. 21, 1994).

*Primary Examiner*—Leo B. Tentoni
*Attorney, Agent, or Firm*—Howson & Howson

[57] ABSTRACT

The absorbency of regenerated viscose filaments is improved by overfeeding a continuous tow of partially regenerated filaments onto a moving foraminous support so that regeneration occurs prior to and after the filament tow is overfed onto the moving support.

8 Claims, 2 Drawing Sheets

PROCESS OF IMPROVING AT LEAST ONE PROPERTY OF VISCOSE FILAMENTS

BACKGROUND OF THE INVENTION

1. Field of the Invention

This invention relates to fibre webs and has particular reference to the production of continuous filament cellulosic fibre tow webs. In GB-A-1387566 there is described a process for improving the properties of a continuous filament tow web by suspending a running tow in a flowing liquid in the form of a spread band, overfeeding the spread tow onto a moving foraminous support separated from the liquid and to form a coherent web, drying the web and then stretching the web to pull it back into tow form.

2. Description of Related Art

It has now been discovered that by adopting a modification to the process described in GB-A-1387566, the contents of which are incorporated herein by way of reference, an improved tow web structure can be produced.

The present invention is concerned with the production of a continuous tow web of viscose cellulosic fibres. As is well known, viscose cellulosic fibres are produced by spinning viscose dope in the form of a solution of sodium cellulose xanthate having a cellulose content in the range 5 to 12% by weight and a caustic soda content of 4 to 10% preferably 5 to 7% by weight into an acidic regeneration bath, typically containing 7 to 10% sulphuric acid, 10 to 28% sodium sulphate, and 0 to 4%, more specifically 0.5 to 1.5%, zinc sulphate in a bath at 30° to 70° C., more specifically 45° to 60° C., so as to neutralise the alkali and to coagulate and regenerate the cellulose to form cellulosic fibres. The viscose dope may have a full range of salt figures, although 4 to 12 are preferred. Regeneration occurs from the surface of the fibres, where a skin of cellulose is initially formed, through into the interior of the fibres.

SUMMARY OF THE INVENTION

By the present invention, there is provided a process for improving at least one property, particularly the absorbency, of a continuous filament tow of regenerated viscose cellulose filaments, in which process a running tow in a flowing liquid in the form of a spread band is overfed onto a moving foraminous support to separate it from the liquid, so as to form a coherent web, which web is dried, wherein the improvement comprises having the continuous filament tow of cellulosic viscose filaments in the partially regenerated state when it is overfed onto the moving foraminous support so that the regeneration of the partially regenerated viscose occurs prior to and after the filament tow is overfed onto the moving foraminous support.

Preferably, the dried web is then stretched back into tow form. Further preferably, the web is kept in its overfed state during drying. Further preferably the process is carried out by passing the tow through a spreader box and impacting the spread band upon the foraminous support through a wedge-shaped channel. The foraminous support may be moved at a speed in the range 5 to 40 times slower than the rate of feed of the band onto the foraminous support.

The liquid in the spreader box may be acid, alkaline or neutral. It could be water. The liquid may be heated.

The band formed on the foraminous support may be washed by means of conventional wash liquor by spraying or dripping the wash liquor onto the fibre, or by immersion. The web may be dewatered partially by gravity or vacuum suction and/or by passage through the nip of a mangle prior to complete drying in any suitable drying machine such as a drum drier or through air dryer.

The dried tow, prior to extension, may have a basis weight (weight per unit area) in the range 500 to 1500 gram/square meter, preferably in the range 650 to 850 gram/square meter.

The continuous filament tow made by the process of the invention is particularly suitable for use where an absorbent product is required, such as in sanitary applications, absorbent pads, tampons, sponges, and non-woven fabric products.

The filaments can have a decitex in the range 0.5 to 5 or 0.5 to 10 or 0.5 to 20 dtex. A preferred decitex range is between 1 and 4.

A dam may be provided in the spreader box which is inclined at an acute angle to the base of the box (eg. in the range 30° to 70°, preferably 40° to 60°, more preferably 50° to 55°).

The spreader box may be two to twenty times the width of the running tow fed to it.

The base of the spreader box may be included at an angle in the range 3° to 10° to the horizontal.

The spreader box may include a baffle beneath which the tow is passed prior to ballooning upward outward and downward before passing out through a elongate slit or a fish tail at the downstream edge of the box.

The present invention also provides a tow web produced by the process of the invention and an absorbent product incorporating a tow web of the invention.

The present invention further provides a method of forming a tow web of regenerated viscose cellulosic filaments which includes the step of entraining a running tow in a flowing liquid in the form of a spread band, overfeeding the spread band onto a foraminous support to separate it from the liquid so as to form a coherent web and drying the web, wherein the overfeed ratio between the speed of the tow and the speed of the foraminous support is in the range 5:1 to 40:1, preferably 15:1 to 30:1, preferably 20:1 to 25:1.

The present invention also provides a tow or product produced from or incorporating the continuous filament tow product produced by the process of the invention.

BRIEF DESCRIPTION OF THE DRAWINGS

By way of example, embodiments of the present invention will now be described with reference to the accompanying drawings, of which.

DESCRIPTION OF THE PREFERRED EMBODIMENTS

Viscose cellulose filaments may be produced in a conventional manner by the extrusion or spinning of a viscose dope through a spinnerette into an acid bath either vertically or horizontally. The viscose filaments may be of a conventional round cross-section, or may be of a trilobal, Y-shaped, L-shaped, X-shaped, flat or any other suitable cross-sectional shape and may be hollow, inflated filaments. The filaments may be simple regular viscose filaments or modal viscose and may contain additives such as a matting agent, eg: $TiO_2$ or an absorbent enhancing material such as carboxymethyl cellulose or any other suitable additive. The viscose dope may contain polyethylene glycol or other known additives and modifiers such as polyalcohols, soluble dithiocarbonates, soluble aliphatic and alicyclic amines, oxyethanols and quinoline.

Figure 1:
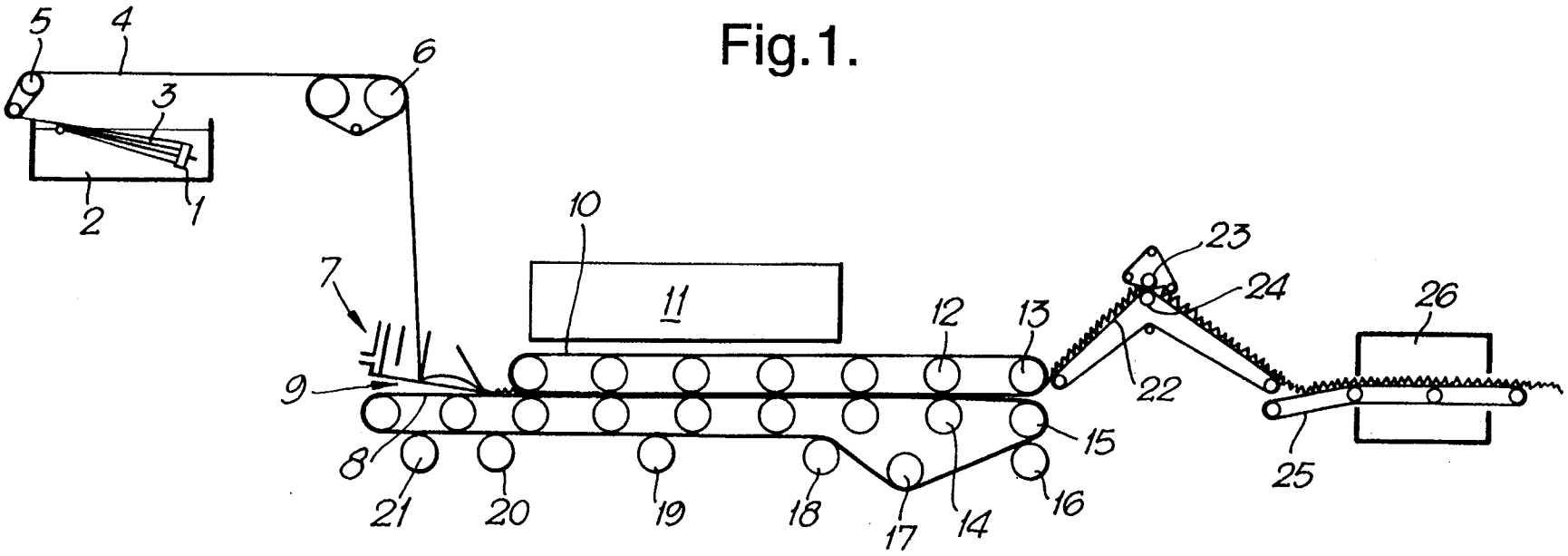
FIG. 1 is a diagram of a tow-web process line.

Referring to FIG. 1, this shows the overall tow-web processing system. Dope is extruded through a spinnerette 1 (which may be a cluster jet) into a spin bath 2 so as to form a plurality of elongate members 3. The viscose dope has a salt figure in the range 5.5 to 6.5 and contains 4% polyethylene glycol (PEG) having a molecular weight of 1,450. The spin bath 2 contains an aqueous solution of sulphuric acid, zinc sulphate, and sodium sulphate. Typically, the concentration of the spin bath acid can be in the range 7 to 9.75%, there would be about 1% zinc in the spin bath, based on zinc sulphate, and 22 to 25% sodium sulphate. Further particulars are given below in relation to the specific tests carried out to produce product in accordance with the invention.

On emerging from the spinnerette 1, the viscose solution immediately coagulates and forms a cuticle or exterior layer of cellulose around each emerging elongate member. Coagulation and regeneration of the cellulose then occurs as a diffusion-controlled process with the diffusion of acid into the elongate members to regenerate the cellulose and to liberate carbon disulphide.

Regeneration does not occur immediately, but takes a finite period of time as will be discussed below.

The regeneration of the elongate members to form cellulose filaments occurs throughout a significant portion of subsequent processing after emerging from the spinning bath 2 and during washing. Regeneration may be taken to be occurring during such period as $CS_2$ is released by the fibre. Regeneration is not complete before all the cellulose xanthic acid in a filament has decomposed to form cellulose and $CS_2$ and subsequently all the $CS_2$ has been liberated from the filament.

The elongate members 3 now considered to be in the form of filaments are gathered together as a continuous tow 4 which may be slightly spread by passing over bowed rollers and which is passed over rollers 5, 6 and passed in a parallel and untangled manner into a spreader box 7, further details of which will be given below. Emerging from the downstream end of the spreader box 7, the continuous tow is overfed onto a continuous mesh belt 8 (which may be inclined or flat) and the tow may be sucked down onto the belt, which is moving in the direction of arrow 9. The tow 4 is produced at a spinning speed of 20 meters per minute and the belt 8 is moved at a speed of 1 meter per minute. Thus, the tow is overfed onto the belt 8 at a ratio of 20:1 to form a web. The continuous filament tow web is then trapped between the foraminous mesh belt 8 and an upper belt 10 which, initially, only loosely grips the tow web as it lies on the lower belt 8. The laid out tow web, referred to herein as a spread laid web is still undergoing regeneration with the formation of cellulose and the emission of carbon disulphide as the tow is laid onto the foraminous mesh belt 8. The upper belt may only be present over the portion of the mesh belt 8, in particular that portion where the web is washed (see below).

A series of washing heads are positioned within a washing machine 11 over the belt 10 to spray wash liquor (eg. water) over the spread lain web to continue the regeneration and to wash out the acid and carbon disulphide from the web. There may be provided suction through that portion of the lower belt which is beneath the upper portion of the belt 8 to remove the wash liquor.

As the spread laid web approaches the downstream ends of the belts 8 and 10 it passes through a first nip created between rollers 12 and 14 and a smaller second nip created between rollers 13 and 15 to squeeze excess water from the spread laid web. It can be seen that the endless foraminous belt 8 has a return run which is controlled by a series of lower rollers 16 to 21. A finish or softener may be dripped onto the tow between rollers 12 and 13. Typical finishes include soap (sodium oleate/oleic acid), PEG esters or glycerol or other suitable fibre finishes.

The spread laid tow is then passed along a further belt conveyor 22 up into the nip of a mangle 23, 24 (which may be heated). The tow then passes down an inclined portion of the conveyor 22 and is laid onto a further endless belt 25 which passes through a drier 26. Nonwoven fabrics would typically have a basis weight of 40 gsm, but the tows of the invention preferably have very much higher basis weights, which means that the dried tows are very much thicker—possibly up to 40 times thicker. This results in greater intermingling of the filaments, and this in turn leads to different physical properties in the tow.

Figure 2:
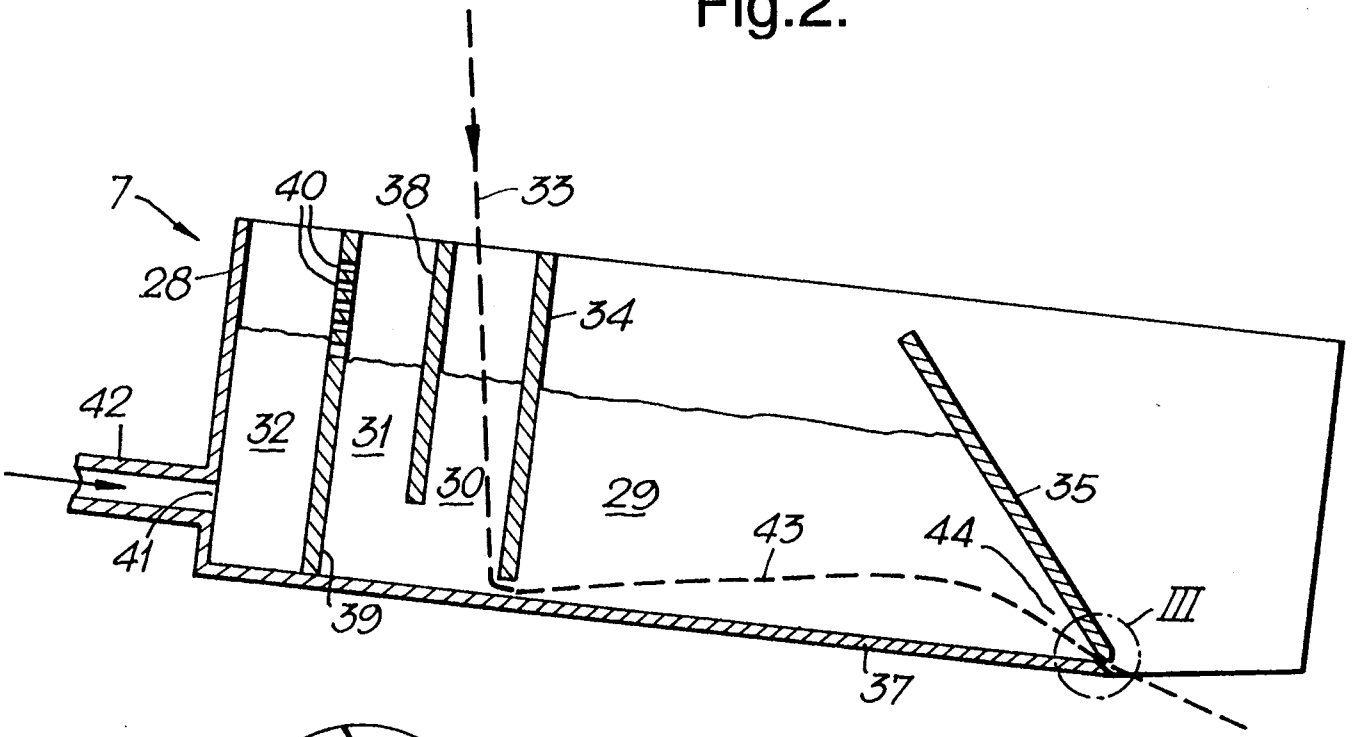
FIG. 2 is a cross-section of a spreader box forming part of the line of FIG. 1.
Figure 3:
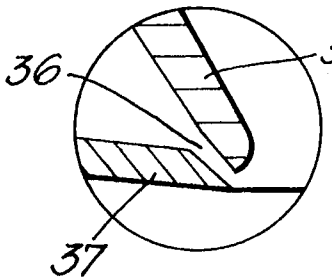
FIG. 3 is an enlargement of a portion in the circle III of FIG. 2.

FIGS. 2 and 3 show the spreader box 7 of FIG. 1 in more detail. The spreader box 7 essentially comprises a rectangular box 28 having a series of chambers 29, 30, 31, 32 built into the box. Tow 4 from the spin bath follows the dotted line 33 through the spreader box. The tow first enters chamber 30 and passes underneath a downwardly-directed baffle 34 to enter the chamber 29. Within the chamber 29, the tow moves upwardly and enters a region adjacent an inclined dam wall 35 to be forced through an exit aperture 36 (shown more clearly in FIG. 3) formed between the dam wall 35 and a base 37 of the box 28.

The chamber 30 is in direct communication with a further chamber 31 via the underside of a further downwardly directed baffle 38. A yet further baffle 39 having apertures 40 in its upper portion separates chambers 31 and 32.

Acid liquor which is more dilute than that contained in the spin bath 2 (but still sufficiently acidic to continue the regeneration) is forced into the spreader box 28 through an aperture 41, via an inlet pipe 42. However, to restrict the regeneration of the two prior to overfeeding, plain hot water or even slightly alkaline liquor could be used.

The liquor flows through the spreader box via chambers 32, 31, 30 and 29 and leaves the spreader box via aperture 36. The restriction caused by the dam wall 35 and the small size of the exit aperture tends to force the tow upwardly in its passage through chamber 29 to follow roughly along the line 43. This causes the tow to spread across the entire width of the spreader box and to go from a substantially compact almost circular tow in the region of portion 33 into a spread tow in the region 44 as it approaches the exit aperture 36—a slit of 2–3 mm width, which may be adjustable.

It is believed that the tow spreads because liquor moves more slowly within the tow compared to the outside. This is due to frictional forces between the liquor and the tow filaments which slow the fluid down.

This difference in fluid velocity causes a pressure differential across the tow (lower pressure on the outside) and a force is generated which causes the tow to spread. This spreading occurs until pressure is equalised on all filaments i.e. when the filaments are equally spread across the width of the box. The degree of spreading is mainly controlled by the speed of the tow through the box, the speed of the liquor and the configuration of the box, particularly its depth. The faster the tow is spun, the faster liquor needs to be pumped through the box or the greater the depth of liquor needed to achieve satisfactory spreading. Liquor flows through the box would be in the range 10–20 liters/min, preferably 30–80 liters/min.

The angle of the dam wall 35 to the base 37 is shown as about 50°. The base 37 is inclined downwardly at some 6° to the horizontal.

Four sample tow webs were produced from viscose solutions having differing salt figures. These four samples were each spun through a spinnerette containing 17,388 Y-section holes, so as to produce tow webs having a total rex in the range 5000 to 8000, the tow being formed of individual filaments of decitex as set out in the tables below. In each case, the viscose contained 4% PEG 1450 based on the weight of cellulose in the viscose solution. The samples were spun at 15 meters per minute and the belt 8 was operated at 0.75 meters per minute.

The values for salt figure, spin bath acid, spin bath zinc, spin bath sulphate, spin bath flow, air stretch stretching in the atmosphere between rollers 5 and 6, and hot stretch—stretching in a bath of spin liquor at a temperature of 95° C.—were as set out in Table 1 below.

TABLE 1

Specification of Tow Web Samples.

| Sample No. | 1 | 2 | 3 | 4 |
|---|---|---|---|---|
| Salt Figure | 6.5 | 6.2 | 5.5 | 5.8 |
| % Spin Bath $H_2SO_4$ w/w | 9.28 | 9.26 | 9.35 | 9.52 |
| % Spin Bath $ZuSO_4$ w/w | 0.95 | 0.97 | 0.98 | 1.00 |
| % Spin Bath $Na_2SO_4$ w/w | 23.6 | 23.8 | 24.0 | 24.1 |
| Spin Bath Flow (1/min) | 50 | 50 | 50 | 65 |
| % Air Stretch | 7 | 7 | 7 | none |
| % Hot Stretch | none | none | none | 7 |

The air stretch may be in the range 0 to 30%, or 5 to 20%.

The physical properties of the tow web samples were then measured to give the information contained in Table 2 below.

TABLE 2

Physical Properties for Tow Web Samples.

| Sample No. | 1 | 2 | 3 | 4 |
|---|---|---|---|---|
| Decitex | 3.32 | 3.82 | 3.08 | 4.52 |
| % Extension | 30.25 | 41.01 | 31.81 | 41.53 |
| Tenacity (cN/tex) | 11.02 | 10.45 | 10.96 | 11.35 |
| Crimp Frequency (waves/cm) | 1.01 | 1.01 | 1.41 | 1.01 |
| Crimp Ratio | 2.83 | 2.23 | 2.39 | 2.81 |
| Crimp Amplitude (mm) | 2.33 | 2.22 | 1.65 | 2.31 |
| Fabric Weight (gsm) | 650 | 650 | 650 | 650 |
| Absorbency (g/g) | 4.2 | 4.4 | 4.3 | 3.9 |
| Stability (mm) | 15 | 13 | 14 | 14 |

It can be seen that Sample 4, which will be more regenerated than Samples 1 to 3, because the hot stretching causes more rapid regeneration, is less absorbent than the other samples, even allowing for its greater decitex.

The absorbency and stability are measured as a longitudinally expanding tampon having an average weight of 2.72 g and an average density of 0.35/cm$^3$ in a modified Syngina as defined in GB-B-2,094,637 (the contents of which are incorporated herein by way of reference) except that a 18 mm head of water was used. The tow webs preferably have a total kilotex in the range 1 to 30, further preferably 3 to 15 or 4 to 9.

In a further series of tests, the overfeed ratio was varied whilst all other conditions and materials were kept the same. The results are given below.

TABLE 3

| Overfeed Ratio | Absorbency (g/g) |
|---|---|
| 10:1 | 4.2 |
| 15:1 | 4.4 |
| 20:1 | 4.6 |

Additional entanglement of the tow web may be provided, either in the spreader box by internal turbulence, or by providing hydroentangling heads later along the line. Extra entanglement increases absorbency.

Two or more tows, may be laid on top of one another for washing and drying purposes.

The dried tow may, if required, be pulled out either in an elongate direction along the length of the tow, or transversely, or both, to produce a product having enhanced absorption capacity. If required, the tow may be used in -the unstretched condition. The tow may be used for any suitable application such as in absorbency products, typically sanitary products or incontinence products, tampon products of any conventional structure, sponges, or non-woven structures generally, such products having properties commensurate with the use of the novel tow in such a structure.

The wash liquor used may be slightly more alkaline than would otherwise be used in a conventional viscose regeneration process.

We claim:

1. In a process for improving at least one property of a continuous filament tow of regenerated viscose cellulose filaments in which process a running tow in a flowing liquid in the form of a spread band is overfed onto a moving foraminous support to separate it from the liquid, so as to form a coherent web, which web is dried, the improvement of having the continuous filament tow of cellulosic viscose filaments in the partially regenerated state when it is overfed onto the moving foraminous support so that the regeneration of the partially regenerated viscose occurs prior to and after the filament tow is overfed onto the moving foraminous support.

2. A process as claimed in claim 1 wherein the dried tow is stretched back into tow form.

3. A process as claimed in claim 1 wherein the process is carried out by passing the tow through a spreader box and impacting the spread tow upon the foraminous support through a wedge-shaped channel.

4. A process as claimed in claim 1 wherein the foraminous support is moved at a speed in the range 5 to 30 times slower than the rate of feed of the spread band onto the foraminous support.

5. A process as claimed in claim 1 wherein the web on the foraminous support is washed by means of a spray wash liquor.

6. A process as claimed in claim 1 wherein the regeneration occurs additionally during the overfeeding process.

7. A process as claimed in claim wherein the web is kept in the overfed state during drying.

8. A process as claimed in claim 6 wherein the flowing liquid is acidic at the point of contact of the tow with the support.

* * * * *

UNITED STATES PATENT AND TRADEMARK OFFICE

CERTIFICATE OF CORRECTION

PATENT NO. : 5,443,776

DATED : August 22, 1995

INVENTOR(S) : Alan J. Bartholomew, Paul L. Probert, Michael Richardson, Andrew G. Wilkes

It is certified that error appears in the above-identified patent and that said Letters Patent is hereby corrected as shown below:

Column 5, line 22, "rex" should read --tex--;
Column 6, line 10, "The tow" should begin a new paragraph;
Column 8, line 1, "claim" should read --claim 1--.

Signed and Sealed this

Sixth Day of August, 1996

*Attest:*

BRUCE LEHMAN

*Attesting Officer*

*Commissioner of Patents and Trademarks*